US007559166B2

(12) United States Patent
Bubits

(10) Patent No.: US 7,559,166 B2
(45) Date of Patent: Jul. 14, 2009

(54) PISTOL WITH CARTRIDGE MAGAZINE

(75) Inventor: Wilhelm Bubits, Brunn/Gebirge (AT)

(73) Assignee: Caracal International LLC, Abu Dhabi (AE)

( * ) Notice: Subject to any disclaimer, the term of this patent is extended or adjusted under 35 U.S.C. 154(b) by 0 days.

(21) Appl. No.: 10/580,735

(22) PCT Filed: Dec. 1, 2004

(86) PCT No.: PCT/IB2004/003934

§ 371 (c)(1),
(2), (4) Date: Mar. 30, 2007

(87) PCT Pub. No.: WO2005/057121

PCT Pub. Date: Jun. 23, 2005

(65) Prior Publication Data

US 2007/0169390 A1 Jul. 26, 2007

(30) Foreign Application Priority Data

Dec. 9, 2003 (AT) ..... A 1972/2003

(51) Int. Cl.
*F41A 9/61* (2006.01)

(52) U.S. Cl. ..... 42/7; 42/18

(58) Field of Classification Search ..... 42/7, 42/18

See application file for complete search history.

(56) References Cited

U.S. PATENT DOCUMENTS 2,305,033 A * 12/1942 Roemer ..... 42/18
3,153,295 A 10/1964 Allyn
4,326,353 A 4/1982 Ludwig et al.
4,539,889 A 9/1985 Glock
4,574,509 A 3/1986 Smith
4,638,581 A * 1/1987 Moore ..... 42/7
4,747,224 A * 5/1988 Smith ..... 42/7
4,768,301 A * 9/1988 Thomas ..... 42/7
4,798,018 A * 1/1989 Johansson ..... 42/7
4,835,892 A 6/1989 Ruger et al.
5,357,703 A 10/1994 Chestnut et al.

FOREIGN PATENT DOCUMENTS

EP 0 251 721 1/1988

* cited by examiner

*Primary Examiner*—Michelle Clement
(74) *Attorney, Agent, or Firm*—Greer, Burns & Crain, Ltd.

(57) ABSTRACT

For a pistol having a hollow pistol grip in which a magazine for rounds which is insertable from below is held, a magazine catch is provided which is realeasable from either side, offers a maximum of safety, is user friendly and has relatively few parts. The magazine has a lug on its front wall; in the front part of the pistol grip a sliding block is arranged so as to be displaceable in transverse direction, which is held in its middle position by at least one spring, in which position the lug rests on the sliding block. The sliding block has a vertical groove on either side of the lug, which can be brought into the path of movement of the lug during insertion of the magazine by displacement of the sliding block in either one of the two directions.

9 Claims, 3 Drawing Sheets

Figure 1:
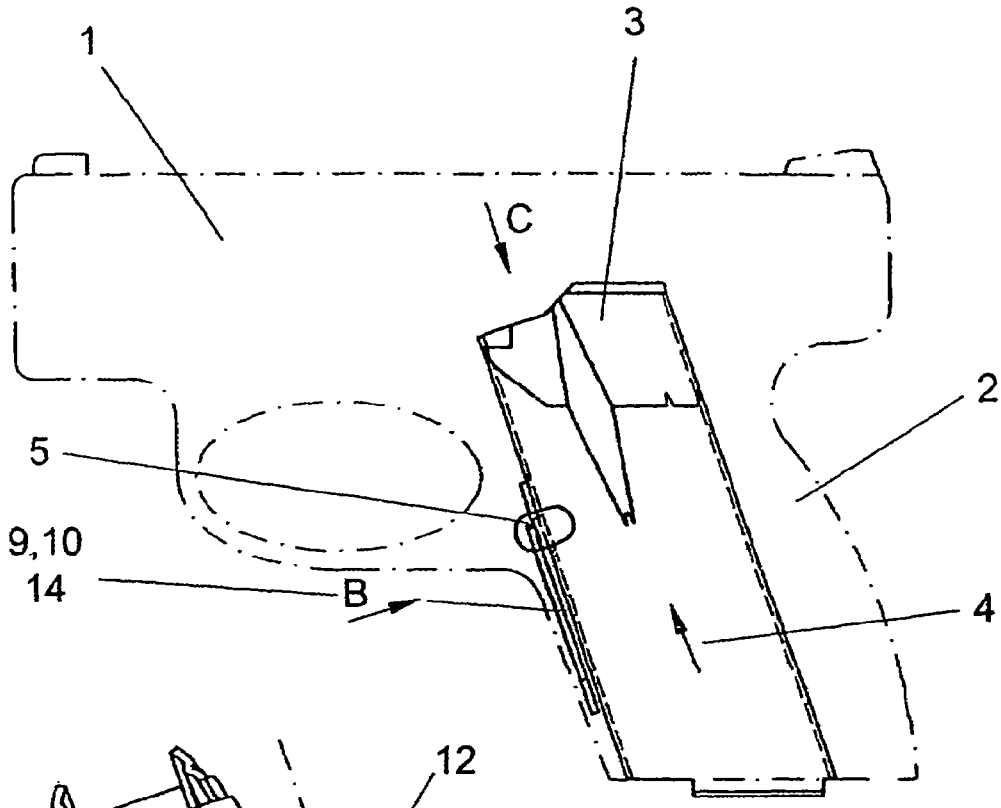

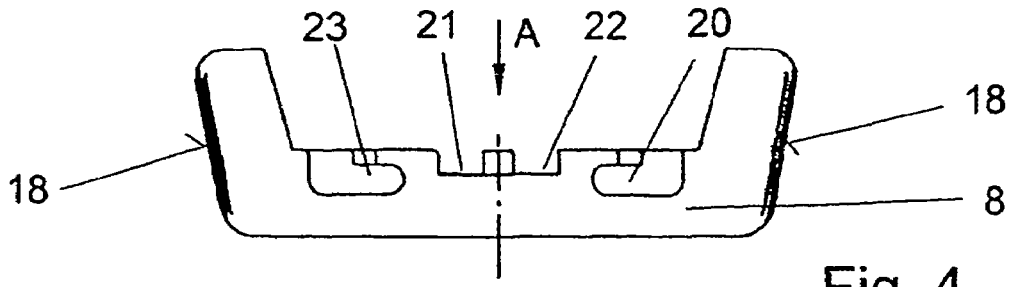
Fig. 4
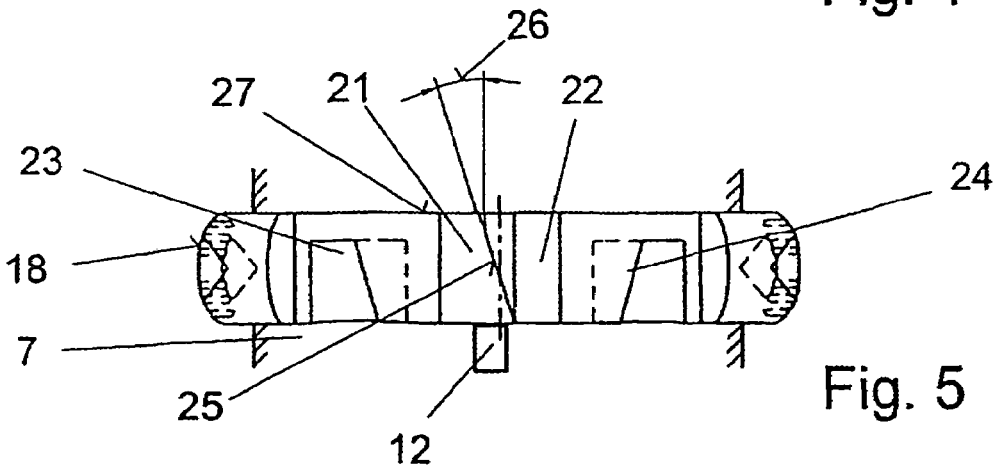
Fig. 5
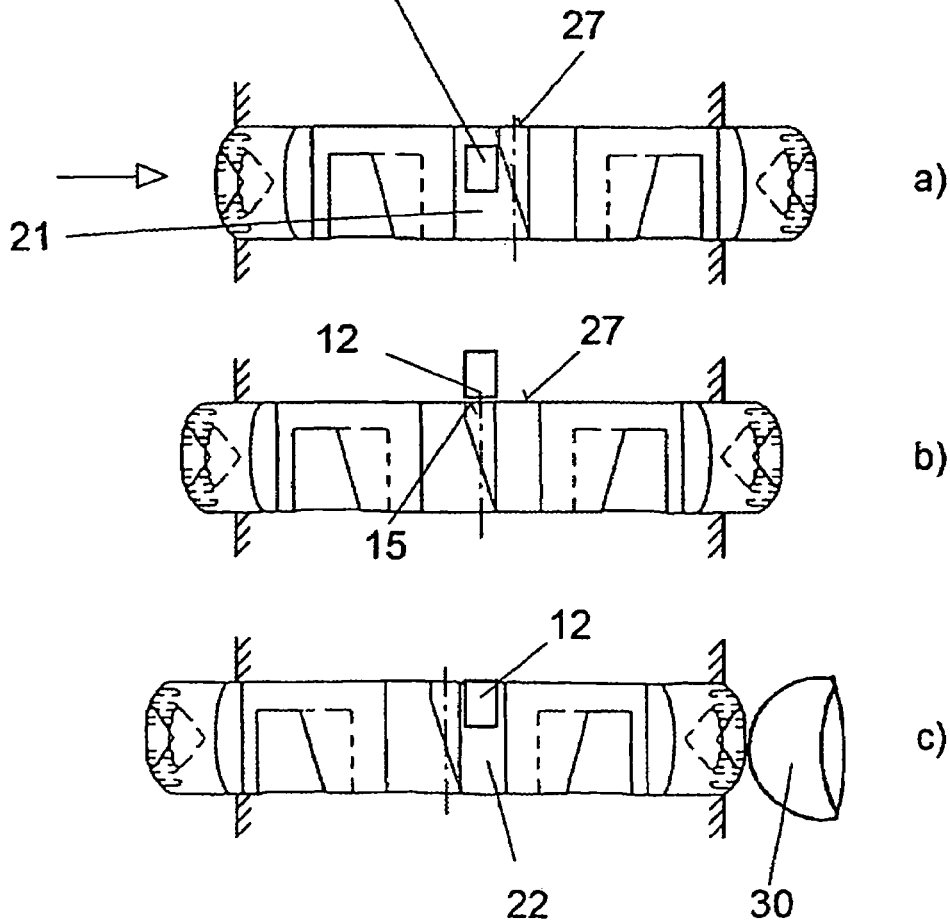

PISTOL WITH CARTRIDGE MAGAZINE

The invention relates to a pistol with a hollow pistol grip which receives a magazine for rounds insertable from below, the magazine, when completely inserted in the pistol grip, being retained by a magazine catch or latch, and being releasable for changing the magazine by actuation of the magazine catch.

Releasing or unblocking of the magazine catch is carried out by the shooter and therefore must meet high ergonomic requirements. Since a pistol must be suitable to be used by one hand, the lever releasing the magazine catch in most cases is arranged on the pistol grip such that it can be reached by the thumb of the shooting hand. Then the magazine exchange proper can be carried out by the second hand.

Recently, there have been increasing demands for magazine catches which can be actuated from either side. This is not only desirable for left-handed shooters, but also for shooting with the "weak shooting hand", which recently has also been integrated in the training guidelines of the police.

In the common pistols, the release lever for the magazine catch is arranged on the left-hand side of the pistol grip, so that it is readily accessible for the thumb of the shooting hand of a right-handed shooter. It acts on the magazine catch which laterally engages on the magazine and therefore is moved transversely to the shooting direction for releasing. Some pistols can also be comparatively easily adapted for left-handed shooters. This, however, does not meet the requirement of the "weak shooting hand".

From practical use, pistols from Heckler & Koch and from Walther are known the magazine catch of which can be released by either one of the two hands. In these pistols, the direction of movement of the magazine catch is in the direction of shooting. This has the disadvantage that the magazine catch may become detached and the magazine may fall out due to the rebound impact when shooting or when a pistol is dropped and falls on a hard ground.

Therefore, it is an object of the invention to provide a magazine catch which is releasable from either side, with a maximum of safety, which is user friendly and which has a minimum of parts which are readily producible.

According to the invention, this is achieved in that the magazine has a lug on its front wall, that a sliding block or magazine latch is arranged in the front part of the pistol grip to be displaceable in transverse direction, which sliding block is held in a middle position thereof by at least one spring, in which middle position the lug of the magazine rests on the sliding block, and that the sliding block has a respective vertical groove on each side of the lug, which groove, by displacement of the sliding block from the outside in either one of the two directions, can be brought into the path of movement of the lug when inserting the magazine.

Thus, a release of the magazine catch is effected by a movement transversely to the shooting direction without any intermediate member by pressing on one of the two ends of the sliding block which project from the pistol grip. The right-handed shooter will press with the thumb on the left-hand end, the left-handed shooter will press on the right-hand end. The sliding block itself substantially is a pin with a support face and two grooves of rectangular cross-section, and thus, is very easy and inexpensive in manufacturing. It is also easy to attach the lug on the magazine of rounds.

In a further development of the invention, the sliding block is held in its middle position by two counter-acting bar springs which are approximately vertically mounted in the interior of the pistol grip. Despite high resilient forces, the substantially bar-shaped springs require hardly any construction space in the interior of the pistol grip (in comparison with helical springs or with hairpin springs).

Preferably, stop faces are provided in the interior of the pistol grip which delimit the bending path of the bar springs. In this way it can be ensured that the sliding block in its simplest embodiment possible cannot be shifted out of the pistol grip.

In a preferred embodiment of the invention, one of the two grooves widens downwardly so that, at its lower end, it extends into the path of movement of the lug during insertion of the magazine of rounds, with the lug temporarily moving the sliding block out of its middle position against spring force. Thus, during insertion of the magazine for rounds, the sliding block is moved laterally by the stiff lug and, when the insertion has occurred, is returned into its middle position by the spring. Production of the lug is very simple and does not require any substantial structural changes of the magazine of rounds; if the magazine is made of sheet metal, simple notching and bending is sufficient; if the magazine is an injection-moulded part, the lug is simply injection-moulded on it.

In another embodiment of the invention, the lug is resiliently elastic on the front wall of the magazine and, by its movable lower end, is seated on the sliding block. In this case, the lug is pressed in, like a latch, by the sliding block when the magazine is inserted, and after having passed the sliding block, the end of the lug becomes seated on the upper side of the sliding block. For a release, the sliding block is shifted in the same manner in one of the two directions, and the lug can slide downwards through one of the two grooves.

Figure 6:
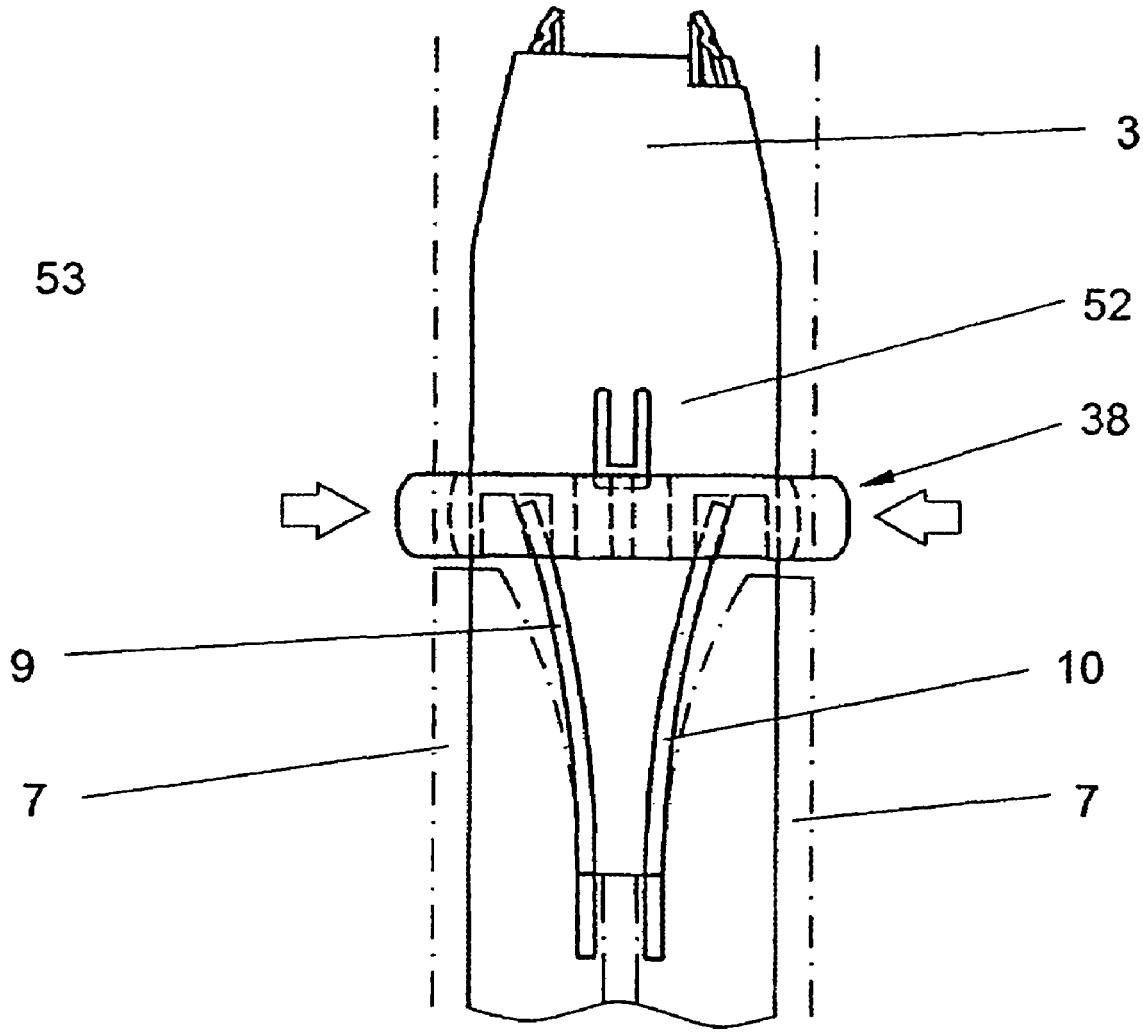
Figure 7:
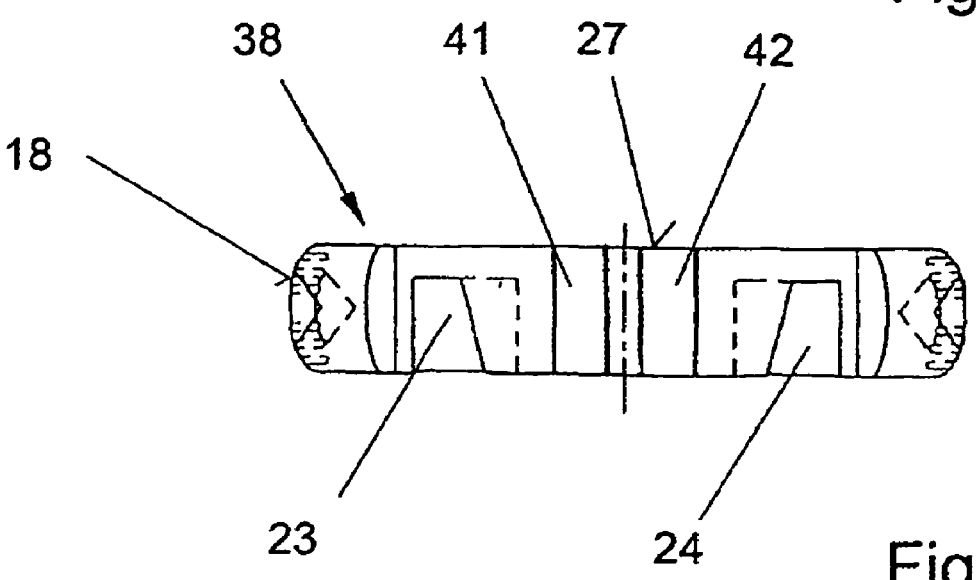

In the following, the invention will be described with reference to drawings. Therein, FIG. 1 outlines a pistol according to the invention, FIG. 2 is a view according to B of FIG. 1, with a transparent pistol grip, FIG. 3 is a view according to C of FIG. 1, with a transparent pistol grip, FIG. 4 is an enlarged detail of FIG. 3, FIG. 5 is a view according to A of FIG. 4, in three positions (a, b, c), FIG. 6 is a variant of FIG. 2, FIG. 7 is the respective FIG. 6—variant to FIG. 5.

In FIG. 1, the contour of the pistol according to the invention is outlined in dot-and-dash lines. Its inwardly hollow pistol grip 2 receives a magazine 3 of rounds, called magazine in short, which is insertable from below (arrow 4). At the level of the shooter's thumb resting on the pistol grip 2, there is an opening 5 on both sides thereof, through which a release device for the magazine 3 projects on both sides.

Figure 2:
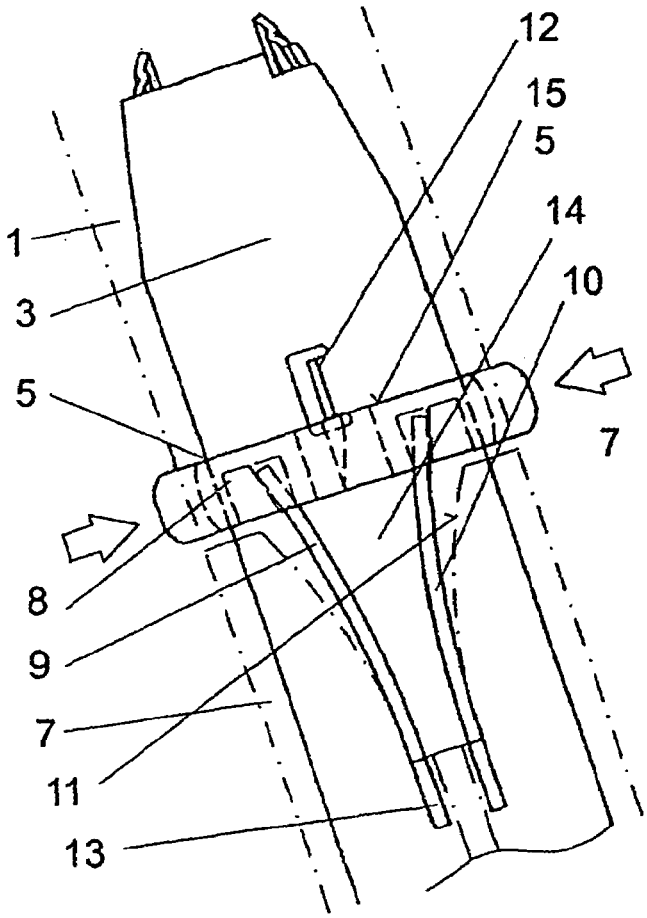
Figure 3:
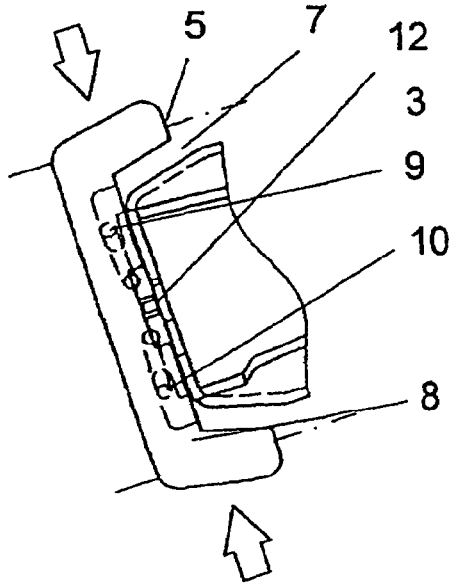

In FIGS. 2 and 3, the release device itself can be seen. The openings 5 pass through the two side walls 7 of the pistol grip 2 and guide a sliding block 8. The latter is held in its middle position by two bar springs 9, 10, if no external forces act on the sliding block. The bar springs 9, 10 are, e.g., resilient wire pieces and are perpendicularly arranged in a shallow niche 14 in the front wall of the pistol grip 2. The lateral delimiting walls of the niche 14 form stop faces 11 for the bar springs 9, 10, whereby the displacement path of the sliding block 8 is delimited. The lower ends of the bar springs 9, 10 each are seated in a bore 13, and their upper ends act in opposite directions on the sliding block 8. The two bar springs 9, 10 could also be a single bar, bent in U-shape at its bottom, their cross-section may be round or flat. In any way, such a shape and arrangement of the springs offers a maximum of force at a minimum of space required (cf. 9, 10, 14 in FIG. 1).

In FIGS. 2 and 3, also the front wall of the magazine 3 with a lug 12 is visible. If the magazine 3 is made of sheet metal, the lug can simply be made by notching and bending out, as in the embodiment described here. However, it could also be welded on, or injection-molded to a plastics magazine. In any case, here it is a stiff body with a horizontal supporting area 15 which cooperates with the sliding block 8 in a manner still to be described.

In FIG. 4, a detail of the sliding block 8 is to be seen from the bottom side, and in FIG. 5 it can be seen from the rear side. It is an approximately parallelepiped body, having ends provided with pressure pieces 18 with a corrugated surface and an enlarged cross-section. Their contour corresponds to the shape of the openings 5. A guiding face 20 at the side of the sliding block 8 facing the magazine 3 is interrupted by two vertical grooves 21, 22 provided somewhat eccentrically and having a rectangular cross-section. The first groove 21 is widened downwardly in that the wall 25 located more closely to the center is inclined by an angle 26 and extends to beyond the center line. The second groove 22 has a constant cross-section. Between the upper ends of the two grooves 21, 22, the sliding block 8 has a support face 27 for the supporting area 15 of the lug 12. Between the grooves 21, 22 and the pressure pieces 18 provided on both sides, pockets 23, 24 are provided for engagement of the upper ends of the bar springs 9, 10 therein.

The mode of action of the device according to the invention is described by way of FIG. 5 and different stages a), b) and c): In FIG. 5, the sliding block 8 is in its central position of equilibrium. The magazine 3 is just being inserted from below, and its lug 12 has just reached the entrance of the first, widened groove 21.

In stage a), the lug 12 slides upwardly in groove 21, moving the sliding block 8 towards the right-hand side, against the force of the spring 9, as a consequence of the inclined wall 25.

In stage b), the lug 12 has reached the level of the support face 27, the spring 9 returns the sliding block 8 into its middle position, with the support face 27 sliding to below the supporting area 15 of the lug 12. The magazine has now been completely inserted and is locked in this manner.

In stage c), the shooter (with his/her thumb 30) has released the magazine 3 for an exchange, by having pressed the sliding block 8 towards the left-hand side against the force of the spring 10. When the lug 12 has arrived above the second groove, it can move downwards, and so can the magazine. Just as well, however, the magazine catch can be released by pressing at the other side. Then the lug 12 falls through the first groove 21.

In the modified embodiment of FIGS. 6 and 7, the same parts again have the same reference numerals. The difference resides in the shape of the grooves of the sliding block 38 and in the resiliently elastic lug 52 on the front wall of the magazine 3. The two grooves 41, 42 have constant cross-sections. During insertion of the magazine 3, the resiliently elastic lug is pressed at it in the manner of a latch, reaching its locked position without lateral displacement of the sliding block 38, in which locked position the supporting area 15 rests on the support face 27. Release of the magazine catch again is effected as described above.

The invention claimed is:

1. A pistol including a hollow grip, in combination with a magazine for rounds, comprising:

the hollow grip defining a longitudinal axis and being arranged to accommodate the magazine when inserted along said axis and having a front part which has a slide-type magazine latch for displacement transversely to the axis;

the magazine having a front wall including a projecting lug cooperating with the magazine latch by engaging said magazine latch when said magazine is accommodated in said grip;

wherein the magazine latch has two projecting ends, each of said ends having a grip portion, said magazine latch defining two grooves, each of said grooves extending generally parallel to said axis defined by said grip on each side of said lug along said axis so that the lug is movable though one of said two grooves dependent on the transverse displacement of the magazine latch; and a spring mounted in the hollow grip and engaging the magazine latch to hold it in a middle position from which it may be displaced transversely, against the force of the spring, in the one or the other direction, dependent on which grip portion of the magazine latch is pressed.

2. A pistol with a magazine for rounds according to claim 1, wherein the magazine latch is held in said position by two counter-acting bar springs which are approximately vertically mounted in the interior of the pistol grip.

3. A pistol with a magazine for rounds according to claim 2, further including stop faces provided in the interior of the pistol grip which delimit the path of the bar springs.

4. A pistol with a magazine for rounds according to claim 1, wherein one of said two grooves widens downwardly so that, at its lower end, it extends into the path of movement of the lug during insertion of the magazine, wherein the lug temporarily transversely displaces the magazine latch out of said middle position, against the force of the spring.

5. A pistol with a magazine for rounds according to claim 1, wherein the lug of the magazine is attached by notching and bending out.

6. A pistol with a magazine for rounds according to claim 1, wherein the lug is integrally formed with the magazine.

7. A pistol with a magazine for rounds according to claim 1, wherein the lug on the front wall of the magazine of rounds is resiliently elastic and, by its movable lower end, is seated on the magazine latch.

8. A pistol with a hollow grip in combination with a magazine for rounds, comprising:

a hollow grip defining a longitudinal axis, being arranged to accommodate a magazine when inserted along said axis, and including a front part that has a slide-type magazine latch being displaceable transversely to said axis in either the right or the left direction;

the magazine comprising a front wall and a lug projecting from said front wall, and wherein the magazine cooperates with the magazine latch by engaging the magazine latch when the magazine is accommodated in said grip;

the magazine latch comprising two projecting ends, each of said ends having a grip portion, said magazine latch defining two grooves, each of said grooves extending parallel to said axis defined by the grip on each side of the lug so that the lug is movable though one of said grooves dependent on the direction of the transverse displacement of the magazine latch; and a spring mounted in the hollow grip and engaging the magazine latch to hold it in a middle position from which it may be displaced transversely, against the force of the spring, in a selected transverse direction;

wherein the direction of transverse displacement of said magazine latch is dependent on which gripping portion of the magazine latch is pressed.

9. A pistol comprising:

a hollow grip defining a longitudinal axis and including a front part and a magazine latch mounted in said front part;

a magazine having a front wall and a lug projecting from said front wall, and said magazine being insertable into said grip along said axis to a locked position;

said magazine latch having a left projecting end, a right projecting end, a left grip portion, a right grip portion, a left groove, and a right groove, said grip portions being associated with said projecting ends respectively, and when said magazine is in said locked position, said magazine latch engages said magazine and said lug engages said magazine latch between said left groove and said right groove; and a spring mounted in said grip and holds said magazine latch in a position from which said magazine latch is transversely displaceable in a selected one of either the left or the right transverse directions against the force of said spring;

wherein said selected transverse direction is selectable based on pressure being applied to either said left or said right grip portion of the magazine latch, and said lug is movable through one of said grooves dependent on the selected direction of the transverse displacement of the magazine latch.

* * * * *